US006523904B1

(12) United States Patent
Vanderminden

(10) Patent No.: US 6,523,904 B1
(45) Date of Patent: Feb. 25, 2003

(54) OUTDOOR FURNITURE CONSTRUCTION

(75) Inventor: William M. Vanderminden, Middle Granville, NY (US)

(73) Assignee: Telescope Casual Furniture, Inc., Granville, NY (US)

( * ) Notice: Subject to any disclaimer, the term of this patent is extended or adjusted under 35 U.S.C. 154(b) by 0 days.

(21) Appl. No.: 09/441,804

(22) Filed: Nov. 17, 1999

(51) Int. Cl.[7] ..... A47C 7/02
(52) U.S. Cl. ..... 297/452.63
(58) Field of Search ..... 297/452.63, 452.64, 297/452.19, 452.18, 452.11, 445.1, 448.1, 451.11, 440.11; 5/191

(56) References Cited

U.S. PATENT DOCUMENTS 3,175,269 A * 3/1965 Raduns et al.
3,363,667 A * 1/1968 Thomas et al.
3,476,169 A * 11/1969 Militano
3,724,402 A * 4/1973 Thyberg et al.
3,751,110 A * 8/1973 Shaw
4,438,800 A * 3/1984 Hemmerle et al.
4,750,784 A * 6/1988 Schwartz
4,928,334 A * 5/1990 Kita
5,131,151 A * 7/1992 Agase et al.
5,318,348 A * 6/1994 Hess
5,445,436 A * 8/1995 Kemnitz
5,645,321 A * 7/1997 Seroldi
5,662,383 A * 9/1997 Hand
5,716,101 A * 2/1998 Frinier et al.
5,762,403 A * 6/1998 Robinson
5,769,500 A * 6/1998 Holbrook
5,836,655 A * 11/1998 Laufer
5,878,451 A * 3/1999 Lumine
6,035,901 A * 3/2000 Stumpf et al.

* cited by examiner

*Primary Examiner*—Milton Nelson, Jr.
(74) *Attorney, Agent, or Firm*—Francis C. Hand, Esq.; Carella Byrne Bain et al.

(57) ABSTRACT

An outdoor furniture frame construction is provided with a pair of fixedly mounted rails across which and into which a plurality of plastic straps are mounted in tensioned manner. Each rail is provided with a slot to receive an enlarged end of a strap as well as a lip defined by the slot and against which a folded over end of each strap abuts. The straps are heated before being mounted in the rails to permit stretching of the strap and placement in the rails. When in place, the enlarged ends of the strap engage against the lip in each rail for anchoring purposes. Damaged straps may be readily removed without having to remove additional straps.

16 Claims, 3 Drawing Sheets

OUTDOOR FURNITURE CONSTRUCTION

This invention relates to an outdoor furniture construction employing a plurality of straps to form at least one of a seat and a backrest and to a method of fabricating the outdoor furniture construction.

As is known, outdoor furniture such as chairs, lounges, foot rests, and the like have been constructed of metal frames and wood frames across which strapping has been secured in order to form a seat, a back rest and/or a foot rest. In some cases, strips of woven materials have been disposed across a frame and secured at opposite ends to the frame by means of fasteners, such as rivets. In other cases, such as for a collapsible Director's chair, a rectangular piece of material has been provided with loops on two sides with dowels slid into the loops and the assembled unit is slid longitudinally into grooves located at suitable points in the collapsible chair. In these cases, the assembled unit is slid into the chair prior to opening of the chair into a usable position. In still other cases, strips of material have been secured in place or have been secured within grooves on each side of a frame by being slid into the grooves longitudinally from one end of the groove.

Generally, the techniques which have been employed to secure a strap or strip to a frame for outdoor furniture have been time consuming or require additional parts, such as fasteners, in order to secure the straps or strips in place. Further, in the event that a strap becomes damaged or broken during use, it has generally been cumbersome for a user to replace the strap. For example, in the cases where the straps have been slid into grooves in the sides of the frame and particularly where the straps are of different colors in order to create a visual effect, it has been necessary to remove all of the straps up to the broken strap from one end of the frame in order to be able to slide a replacement strap into place.

According, it is an object of the invention to be able to fabricate an outdoor frame with straps in a simple manner.

It is another object of the invention to be able to replace broken or damaged straps in an outdoor furniture frame in a relatively simple unencumbered manner.

It is another object of the invention to be able to mount straps for an outdoor furniture in an easy manner without the need for fasteners.

Briefly, the invention is directed to an outdoor furniture construction which is to be provided with transverse straps. Typically, the construction may be used for a chair, a chaise lounge, foot rest or the like.

In accordance with the invention, the construction includes a pair of fixedly mounted rails, each of which includes a longitudinally disposed slot defining a lip and a plurality of plastic straps which are secured to and across the rails in stretched relation, i.e. in tensioned manner. Each strap has an enlarged end which is disposed in a slot of a respective rail and engages with the lip of the rail.

Each plastic strap of the invention is constructed in a unique manner. That is to say, the plastic strap has an extruded length of uniform thickness and a pair of ends, each of which is folded over and bonded to the remainder of the strap to form a free end or edge. When the enlarged end of the strap is placed within a slot of the rail, the end or edge of the strap engages against the lip defined in the rail and prevents pulling out of the strap from the rail.

When employed in a chair, the two rails may be fixed to a frame contoured to form a seat and/or a backrest and secured, in turn, to and between a pair of leg supports. The stretched straps may thus form the seat or backrest or both. A chaise or footrest may be constructed in similar manner.

The invention also provides a unique method of fabricating outdoor furniture which comprises an initial step of securing a pair of rails in a fixed manner, for example, between a pair of fixed leg supports, with each rail having a longitudinal slot defining a lip. Thereafter, each plastic strap with enlarged ends of a plurality of straps is heated to a degree sufficient to allow manual stretching of the strap. One end of the heated strap is then anchored in the slot of one of the rails and the strap is then stretched in order to insert the second end of the strap into the slot of the opposed rail. The free ends of the strap thus engage against the lips of the respective slots while the strap is stretched between the rails. As the strap cools, the strap shrinks slightly thereby increasing the preload in the strap.

In accordance with the invention, the plastic strap is heated to a temperature of 180° F. to 200° F., for example by being immersed in a trough or tank of hot water. Typically, each strap may be manually handled since the time required for inserting each end of the strap into the rails is less than a few seconds.

Any suitable plastic may be used for making the extruded strap. The preferred materials are extrudable thermoplastic materials and in particular, polyvinylchloride.

In the event that a strap of a chair, chaise, foot rest or the like becomes damaged and requires replacement, a user, using simple tools, may easily replace the damaged strap. First, a scissors or the like is used to cut the damaged strap. The resulting two pieces of the strap may then be readily removed from the rails. A fresh strap may then be dropped into a bucket of hot water so as to become soft and pliable and capable of being stretched under a manual pulling force. One end of the heated strap is then inserted into the slot of one rail. The remainder of the strap is then stretched and the second end is placed in the slot of the opposite rail so that the edges of the two ends abut the lips at each slot.

The construction of the strap is such that continuous lengths of strap material may be extruded from an extruder and sequentially cut into desired lengths. Thereafter, the ends of each strap are folded over and bonded by heat to the remainder of the strap. A plurality of thus formed straps may then be incorporated into an outdoor furniture construction to complete the formation of a chair, chaise, foot rest or the like.

Note is to be made that the leg supports and frame of the furniture construction are fixedly secured to each other and are not movable relative to each other. That is to say, the construction is not collapsible.

These and other objects and advantages of the invention will become more apparent from the following detailed description taking in conjunction with the accompanying drawings wherein.

Figure 2:
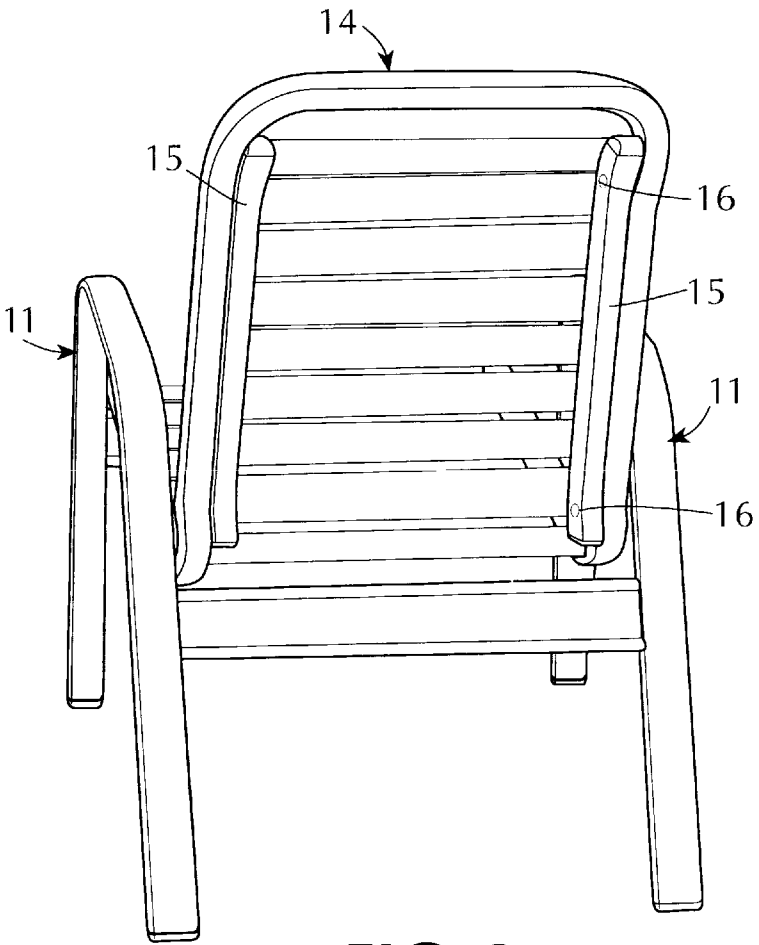
FIG. 2 illustrates a rear perspective view of the chair of FIG. 1.
Figure 1:
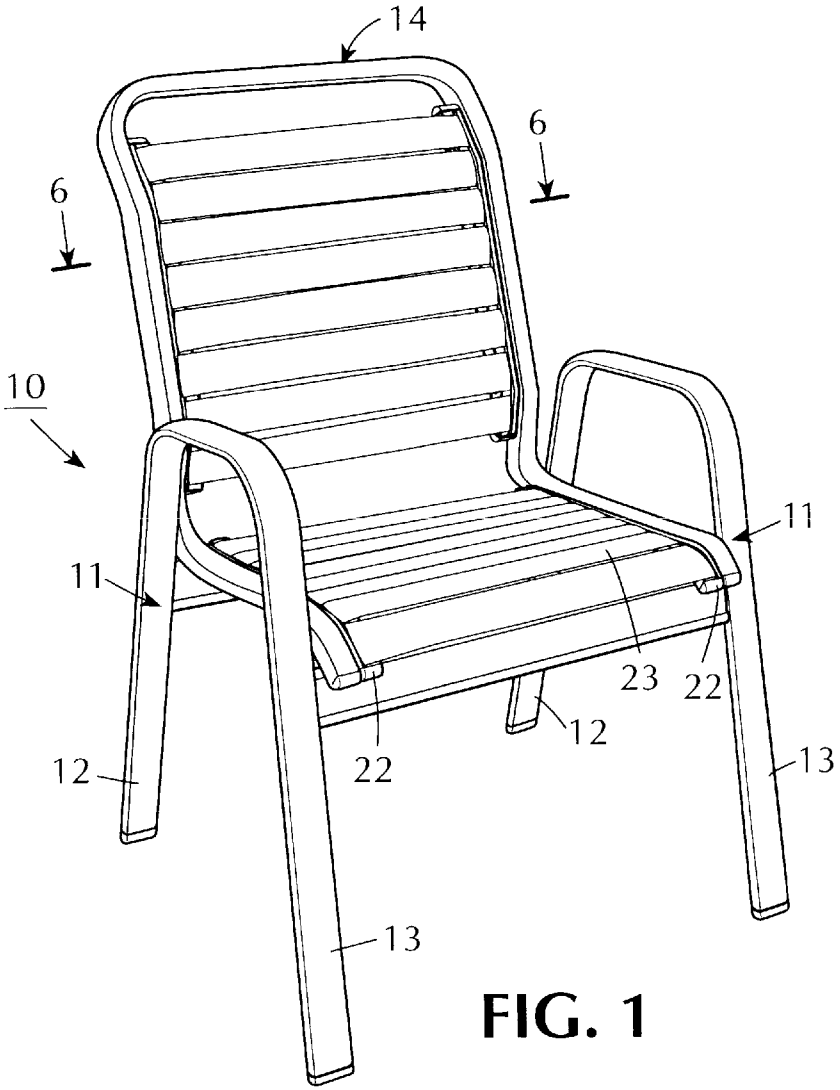
FIG. 1 illustrates a perspective front view of an outdoor chair constructed in accordance with the invention.

Referring to FIGS. 1 and 2, the outdoor furniture construction is illustrated in the form of a chair 10. However, the construction is also suitable for other types of outdoor furniture of skeletal construction, such as chaise lounges, foot rests and the like in which straps may be used to form a surface.

As illustrated, the chair 10 includes a pair of leg supports 11, each of which is shown by way of example as constituting a generally U-shaped frame to define a pair of legs 12, 13.

In addition, the chair 10 includes a frame 14 which is secured to and between the leg supports 11 in fixed relation. Generally, the frame 14 is of a conventional construction, such as a tubular aluminum bar which is contoured as illustrated to form the outline for a seat and a back rest.

Figure 3:
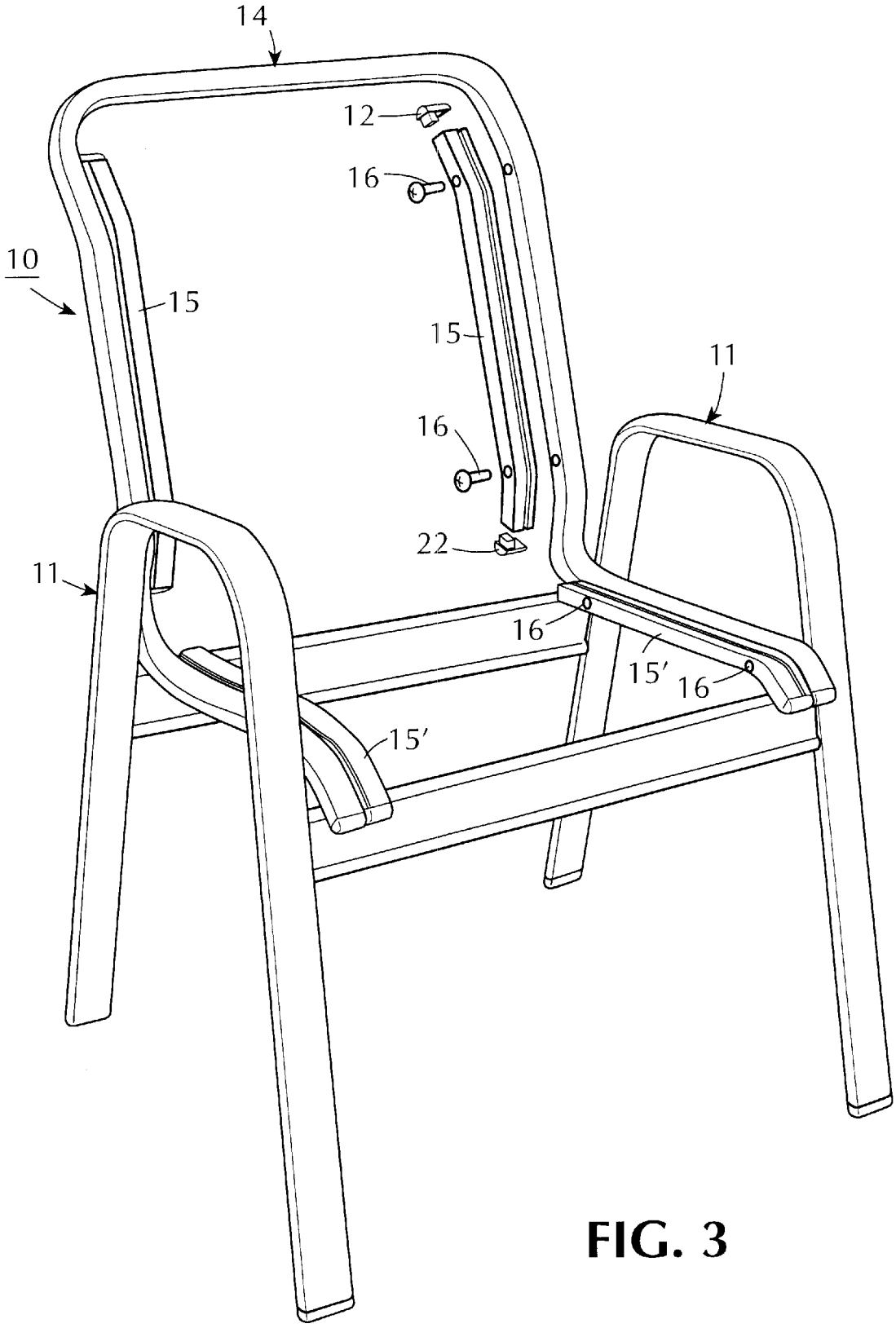
FIG. 3 illustrates a partly exploded view of the chair of FIG. 1 without the straps in place.

Referring to FIG. 3, wherein like reference characters indicate like parts as above, the frame 14 has a pair of rails 15 fixedly secured at opposite sides. As illustrated, each rail 15 is separate from the frame 14 and is secured by a pair of screws or rivets 16 which pass through the rail 15 and the frame 14.

Figure 4:
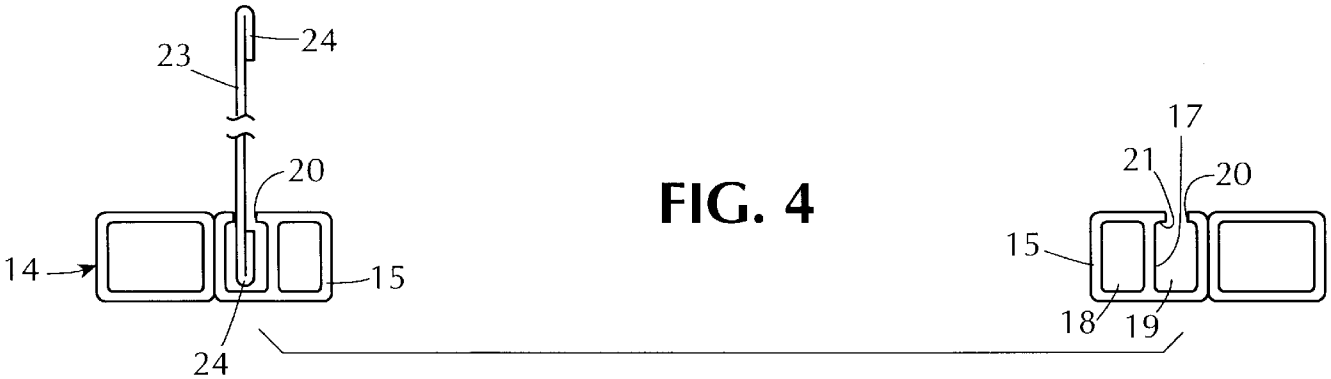
FIG. 4 illustrates a cross sectional view of the chair construction of FIG. 1 during installation of one end of a strap in accordance with the invention.

As shown in FIG. 4, each rail 15 is of hollow rectangular tubular construction and is provided with an interior wall 17 which partitions the rail 15 into a pair of bores 18, 19, each of which extends longitudinally of the rail 15. Each rail 15 also includes a longitudinal slot 20 to define a lip 21 with the bore 19 closest to the frame 14.

As shown in FIG. 3, end caps 22, for example of plastic, are inserted into and over the ends of the rails 15 to seal off the bores 18, 19.

Referring to FIGS. 1 and 2, the chair 10 also includes a plurality of plastic straps 23 which are secured to and across the rails 15 in stretched relation to define a seat as well as a backrest.

Figure 5:
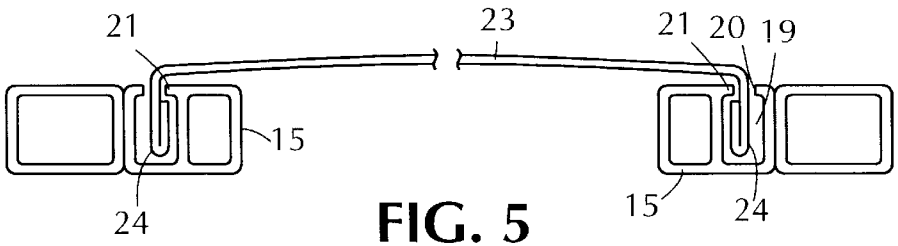
FIG. 5 illustrates a part cross sectional view similar to FIG. 4 during insertion of a second end of a strap in a second rail in accordance with the invention.

Referring to FIG. 5, each strap 23 has an enlarged end 24 which is inserted through the slot 20 into the bore 19 of a respective rail 15. Further, each end 24 of the strap engages with the lip 21 such that the lip 21 prevents the enlarged end 24 of the strap 23 from pulling out of the rail 15.

Each strap 23 is made from an extruded strip of thermoplastic material, such as polyvinyl chloride. To this end, each strap 23 is extruded with a uniform thickness throughout the length. In order to form the enlarged end 24, the end of each strap 23 is folded over into bonded relation to the remainder of the strap 23. Typically, the bonding of the folded over end takes place under heat without the need for adhesives.

Referring to FIG. 4, in order to assemble a strap 23 into the rails 15, the strap 23 is first heated, for example, to a temperature in the range of from 180° F. to 200° F. to allow the strap 23 to become manually stretchable. This may be accomplished by immersing the strap in hot water of suitable temperature.

Figure 6:
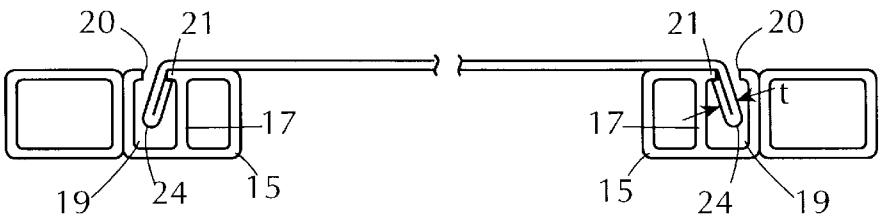
FIG. 6 illustrates a view similar to FIG. 5 and taken on line 6—6 of FIG. 1 of the back rest of the chair.

Once the strap 23 has been heated, one end 24 is inserted through the slot 20 in one rail 15 as indicated in FIG. 4. Next, the strap 23 is manually stretched across the frame and the second end 24 of the strap 23 is inserted through the slot 20 of the opposite rail 15 as indicated in FIG. 5. At this time, the free ends of the strap 23 i.e. the end edges, abut against the lips 21 so that movement of the ends 24 out of the rails is prevented. At the same time, each enlarged end 24 of the strap 23 tends to pivot about the respective lip 21 into a position as illustrated in FIG. 6. Upon cooling, the strap 23 is further tensioned due to the slight shrinkage of the strap 23 between the rails 15.

As indicated in FIG. 5, the tension force in a strap 23 aids in maintaining each enlarged end 24 in abutment with the respective lips 21 to ensure that the strap 23 does not slide transversely out of the slot 19. The tensioned straps 23 also have an advantage in that after an occupant rises out of the chair 10, any sag in the straps 23 caused by the weight of the occupant disappears rather quickly as the straps 23 tend to return to the straight tensioned state in a rapid manner rather than creeping back to that state.

Referring to FIG. 3, a second set of rails 15' is also secured to the frame 14 in order to form a seat and is of similar construction as the rails 15 used to form the back rest for the chair 10.

Alternatively, the rails 15, 15' may be made as an integral part of a frame rather than as separate pieces.

Referring to FIG. 1, should a strap 23 require replacement, the strap 23 is simply cut, as by a pair of scissors. Each piece of the cut strap may then be readily removed manually from the respective rail 15 via the slot 20. Thereafter, a fresh strap may be inserted by the user after first heating the strap to a temperature sufficient to allow stretching. For example, the strap may be placed in a bucket of hot water of suitable temperature. Thereafter, the user would insert one enlarged end into a slot 20 of one rail 15 and would then stretch the strap across the frame in order to insert the second end 24 of the strap 23 into the slot 20 of the other rail 15.

Where desirable, a plurality of straps 23 may be merchandised in sets for replacement purposes. Further, the straps may be merchandised with different colors so that a home owner may change the appearance of previously used furniture from time to time.

When an occupant is seated in the chair 10, the weight of the occupant is absorbed by the straps 23 in the seat of the chair as well as by the straps 23 of the back rest. Thus, the straps 23 which have been mounted under a preload are further stressed in tension. This additional loading places additional stress at the ends 24 of the straps 23 which bias the ends 24 in a direction out of the slot of a rail 15. However, because of the abutment of the free end of the straps 23 against a lip 21 and the fact that the strap 23 is stretched over the rail 15, the end 24 of each strap 23 is securely retained in place. In this respect, the folded-over end 24 of the strap 23 is of a thickness t (see FIG. 6) equal to or slightly less than the width of the slot 20 and about half the width of the bore 19. The lip 21 is of a width of about one-half the thickness t of the folded-over end 24 of the strap 23. Thus, when the strap 23 is put into place and, particularly, when an occupant is seated in the chair 10, the folded-over end 24 becomes angularly disposed in the bore 19 so that the free end of the strap 23 tends to engage in the corner defined by the lip 21 and the partition wall 17. This creates a wedging-in effect of the free end of the strap 23 into the corner defined by the lip 21 and partition wall 17.

The invention thus provides a relatively simple technique for mounting straps into a fixed frame for outdoor furniture use. It is to be noted that the straps are mounted in the furniture frame sequentially and, typically, manually. It is, of course, possible to mount more than one strap at a time.

The invention also provides an outdoor furniture construction in which straps may be readily replaced from time to time if damaged.

It is to be noted that the straps may be fabricated in different colors so that a pattern of colors may be used in a seat and/or backrest. In such cases, should a strap of one color need replacement, only that strap need be replaced without having to remove other undamaged straps.

The invention further provides a technique which may be used by a home owner to easily replace damaged straps in outdoor furniture.

What is claimed is:

1. In an outdoor furniture construction, the combination of a pair of fixedly mounted rails disposed in spaced parallel relation, each said rail including a longitudinally disposed slot defining a lip; and a plurality of plastic straps secured to and across said rails in stretched relation, each said strap having an enlarged end disposed in said slot of a respective rail and having an end edge abutting with said lip of said respective rail.

2. The combination as set forth in claim 1 wherein each end of each said strap is folded over in bonded relation to the remainder of said strap to define said enlarged end and wherein each said end abuts said lip of said respective rail.

3. The combination as set forth in claim 2 wherein each strap is made of polyvinylchloride.

4. An outdoor furniture construction comprising a pair of leg supports;

a frame secured to and between said leg supports in fixed relation and having a pair of rails, each said rail being fixedly secured to opposite sides of said frame and including a longitudinally extending slot to define a lip; and a plurality of plastic straps secured to and across said rails in stretched relation, each said strap having an enlarged end disposed in said slot of a respective rail and having an end edge abutting with said lip of said respective rail.

5. A construction as set forth in claim 4 wherein said rails and straps are horizontally disposed to define a seat.

6. A construction as set forth in claim 4 wherein said rails and straps are vertically disposed to define a backrest.

7. A construction as set forth in claim 4 wherein each end of each said strap is folded over in bonded relation to the remainder of said strap to define said enlarged end and wherein each said end abuts said lip of said respective rail.

8. A construction as set forth in claim 7 wherein each strap is made of an extruded thermoplastic material.

9. A construction as set forth in claim 8 wherein each strap is made of polyvinylchloride.

10. An outdoor chair comprising a pair of leg supports;

a frame fixedly secured to and between said leg supports;

a pair of horizontally spaced parallel rails secured to said frame, each said rail having a longitudinally disposed slot defining a lip; and a plurality of plastic straps secured to and across said rails in stretched relation to define a seat, each said strap having an enlarged end within said slot of a respective rail and having an end edge abutting with said lip thereof.

11. An outdoor chair as set forth in claim 10 which further comprises a second pair of horizontally spaced rails secured to said frame and disposed vertically thereof, each said rail of said second pair of rails having a longitudinally disposed slot defining a lip; and a plurality of plastic straps secured to and across said second pair of rails in stretched relation to define a backrest, each said strap having an enlarged end within said slot of a respective rail of said second pair of rails and engaging with said lip thereof.

12. An outdoor chair as set forth in claim 11 wherein each end of each said strap is folded over in bonded relation to the remainder of said strap to define said enlarged end and wherein each said end abuts said lip of said respective rail.

13. An outdoor chair as set forth in claim 12 wherein each strap is made of an extruded thermoplastic material.

14. An outdoor chair as set forth in claim 13 wherein each strap is made of polyvinylchloride.

15. A plastic strap for outdoor furniture having an extruded length greater than a width thereof and a pair of ends, each said end being folded over and bonded directly to the remainder of said strap.

16. A strap as set forth in claim 15 made of polyvinylchloride.

* * * * *